US009105428B2

(12) United States Patent
Pak et al.

(10) Patent No.: US 9,105,428 B2
(45) Date of Patent: Aug. 11, 2015

(54) METHOD OF EXTINGUISHING AN ELECTRIC ARC IN A LOW OR HIGH VOLTAGE SWITCHGEAR BY PULSE DISCHARGE

(76) Inventors: Chol Min Pak, Manguyongdae District (KR); Sang Hwan Kwon, Mangyongdae District (KR)

( * ) Notice: Subject to any disclaimer, the term of this patent is extended or adjusted under 35 U.S.C. 154(b) by 223 days.

(21) Appl. No.: 13/816,159

(22) PCT Filed: Dec. 9, 2010

(86) PCT No.: PCT/KP2010/000022

§ 371 (c)(1),
(2), (4) Date: Feb. 22, 2013

(87) PCT Pub. No.: WO2012/020853

PCT Pub. Date: Feb. 16, 2012

(65) Prior Publication Data

US 2013/0153540 A1 Jun. 20, 2013

(30) Foreign Application Priority Data

Aug. 9, 2010 (KR) ..... 10-698

(51) Int. Cl.
*H01H 33/04* (2006.01)
*H01H 33/59* (2006.01)

(52) U.S. Cl.
CPC ..... *H01H 33/04* (2013.01); *H01H 33/596* (2013.01)

(58) Field of Classification Search
CPC ..... H01H 2033/66284; H01H 33/16; H01H 33/24; H01H 2033/66276
USPC ..... 218/83, 145–50
See application file for complete search history.

(56) References Cited

U.S. PATENT DOCUMENTS

| | | | | |
|---|---|---|---|---|
| 2,849,659 | A | 8/1958 | Kesselring | |
| 3,495,165 | A * | 2/1970 | Cobine et al. | 324/460 |
| 3,753,042 | A | 8/1973 | Kind et al. | |
| 3,868,550 | A | 2/1975 | Knauer et al. | |
| 4,130,782 | A * | 12/1978 | Dethlefsen | 315/335 |
| 4,314,205 | A * | 2/1982 | Paitich et al. | 324/460 |
| 4,471,309 | A * | 9/1984 | Lange et al. | 324/463 |
| 5,250,906 | A * | 10/1993 | Bills et al. | 324/462 |
| 5,519,323 | A * | 5/1996 | Kordas et al. | 324/444 |
| 2010/0006544 | A1 * | 1/2010 | Onufriyenko et al. | 218/154 |

* cited by examiner

*Primary Examiner* — Truc Nguyen
(74) *Attorney, Agent, or Firm* — Thorpe North & Western, LLP

(57) ABSTRACT

The present invention relates to a method of extinguishing an electric arc, which occurs in low or high voltage switchgears, by pulse discharge. The electric arc is cut like a "fuse" by connecting a condenser (201) to both ends of the electric arc at the moment when it occurs and discharging the condenser (201) through the electric arc. The condenser is charged using a resistor (202) and a diode (203), and its discharge is adjusted by some auxiliary contacts.

8 Claims, 6 Drawing Sheets

METHOD OF EXTINGUISHING AN ELECTRIC ARC IN A LOW OR HIGH VOLTAGE SWITCHGEAR BY PULSE DISCHARGE

BACKGROUND OF THE INVENTION

1. Field of the Invention

The present invention relates to a method of extinguishing an electric arc which occurs in switchgears.

In particular, the invention relates to a method based on a new principle of extinguishing the electric arc in electric way instead of the previous physical way.

2. Description of the Background

Reliability and lifetime of an instrument with contacts depend on how to make the electric arc small and how to extinguish it fast. It is the vacuum technique mainly used in high voltage that is now most superior of the techniques for making an electric arc small and extinguishing it fast. In vacuum circuit breakers the contacts are working under vacuum. Under vacuum the electric arc arises weakly and is easily extinguished since there is little ionization medium there. But the vacuum arc extinguishers are not used in low voltage or high voltage of more than 30 kV since they are difficult to manufacture and their costs are expensive. They are now only used in the switchgears for 3 to 20 kV.

In the common low voltage contactors the methods of extinguishing the electric arc by contacting it to a metal grating or an asbestos board and cooling it are still used and are little changed. Recently studies for extinguishing an electric arc in the low voltage field are intensified and accordingly several treatises are being reported.

In the NingBo Center of Science and Technology in China a method of extinguishing the electric arc in a 380V/65 A contactor using a superconducting magnet was reported in 2008, and in Japan a current break-even method was reported that the electric arc is extinguished by charging a condenser with the supply voltage, then discharging it into a reactor and supplying reversely the resonance voltage to the contacts. But these methods are not yet commercialized due to expensive costs and difficulty of manufacturing.

The switchgears using a SCR or high-capacity transistor are also developed but they can not be used in high voltage or large current since the apparatuses using electronic components have weak dielectric strength and are easily destroyed by an electric shock.

Almost all the recent data are about the improvement of structure base on the existing principle and mainly about the methods of manufacturing circuit breakers by vacuum technique.

The objective of the present invention is to establish a method of extinguishing an electric arc occurring in a low or high voltage switchgear on the basis of a new principle which is completely different from the existing one.

SUMMARY OF THE INVENTION

The present invention is based on a new principle of extinguishing an electric arc.

This principle is, in a word, to cut an electric arc like a "fuse" by supplying a much higher voltage than the arc voltage to its both ends at the moment when it occurs. That is to say, it is to extinguish an electric arc in electric way instead of the previous physical way.

In the present invention an electric arc is extinguished like a "fuse" with a loud explosion sound by connecting the non-polar condenser fully charged up to the maximum of the supply voltage (maximum voltage), the capacity of which can provide with much higher discharge energy than the arc energy, directly to both ends of the electric arc.

The condenser is generally charged using a resistor and a diode. But a resistor is only used in direct current switchgears.

When a switchgear is switched off (the initial state), the condenser is not charged since the charging circuit is cut off. If the switchgear is switched on, the charging circuit is connected and then the condenser is charged up to the maximum voltage by the power-supply source, and in this state the voltage of the condenser is always maintained.

In case the switchgear is switched off again, the condenser is connected directly to both ends of the electric arc and discharged through it at the moment when it occurs. At the same time the electric arc is extinguished and a sound of discharge is heard.

In case the switchgear, which has been switched on, is switched off, it is very important to correctly discharge the condenser at the moment when the electric arc occurs since the motion speed of the moving contact is very fast. This problem is solved using some auxiliary contacts.

In the circuit for adjusting discharge of the condenser some auxiliary contacts are installed and one of them is linked to the moving contact or an intermediate contact-maker is installed between the moving contact and the fixed contact so that the auxiliary contact or the intermediate contact-maker can move according to the motion of the moving contact.

When the switchgear is switched on, the moving contact goes downward, the auxiliary contact linked to it moves along with it at the same time and accordingly the states of the other auxiliary contacts are changed. The intermediate contact-maker installed between the moving contact and the fixed contact moves along with the moving contact from the moment when it is attached to the moving contact which goes downward. This is for keeping the condenser from being connected to both ends of the contact portion of the fixed contact and the moving contact, or of the fixed contact and the intermediate contact-maker, and for connecting the charging circuit.

When the switchgear is switched on, the moving contact goes back upward and then an electric arc occurs between the fixed contact and the moving contact or between the fixed contact and the intermediate contact-maker which is now attached to the moving contact. On the other hand the auxiliary contact linked to the moving contact or the intermediate contact-maker installed between the fixed contact and the moving contact goes upward along with the moving contact, and accordingly the states of other auxiliary contacts are changed again. This is for connecting the condenser to both ends of the electric arc just at the moment when it occurs.

After the electric arc is cut off, the moving contact continues to go upward, the auxiliary contacts return to the original places and thus the switchgear is put in the initial state.

The auxiliary are made of tungsten alloy.

The main and auxiliary contacts in high voltage switchgears are all working in oil in order to keep their dielectric strength.

For the same purpose all the main and auxiliary contacts are also working in vacuum or gas.

The advantages of the present invention are as follows:

First, the lifetime of high voltage switchgears can be much increased by extinguishing the electric arc at the moment when it occurs. (5 to 10 times)

Second, high voltage switchgears can be manufactured easily with much less cost than the vacuum circuit breakers.

Third, maintenance and management of switchgears are very easy.

DETAILED DESCRIPTION OF THE INVENTION

The electric arc which occurs at contacts is a type of gas-plasma.

It is known that plasma gas has a property of turning on an electric current well like a conductor. The difference with a conducting wire is that the form of plasma gas is maintained by the voltage at its both ends and its physical intensity is very weak. It is stressed as to the properties of plasma that the electric current of plasma is almost regarded as one of electrons since the flow of electric current is made by electrons and ions, the numbers of electrons and ions are the same in plasma and the velocity of electrons is about 1,000 times faster than that of ions.

In order to increase the electric current of plasma, the numbers of electrons and ions should be increased or the velocity of electrons should be raised.

The velocity of electrons in plasma relates to the voltage at its both ends.

$$V_e = \left(\frac{2eU_p}{m_e}\right)^{\frac{1}{2}} \tag{1}$$

$V_e$: the velocity of electrons e: electronic charge $m_e$: weight of electron $U_p$: the voltage of plasma (arc voltage)

Figure 1A:
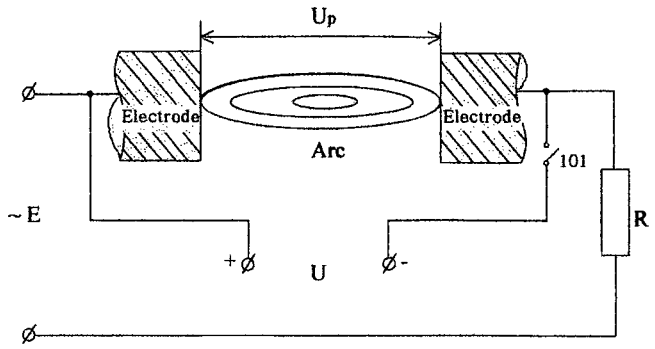
FIG. 1*a* is a circuit for supplying scores of times as high a voltage as the arc voltage from outside to an electric arc.

Suppose that the much higher voltage, U, than the voltage of plasma, Up is supplied to both ends of the plasma with a switch 101 in FIG. 1*a*. In this case the velocity of electrons is changed as follows:

$$V_e' = \left(\frac{2eU}{m_e}\right)^{\frac{1}{2}} = \left(\frac{2eKU_p}{m_e}\right)^{\frac{1}{2}} = \sqrt{K}\cdot V_e \tag{2}$$

$$(K = U/U_p)$$

Figure 1B:
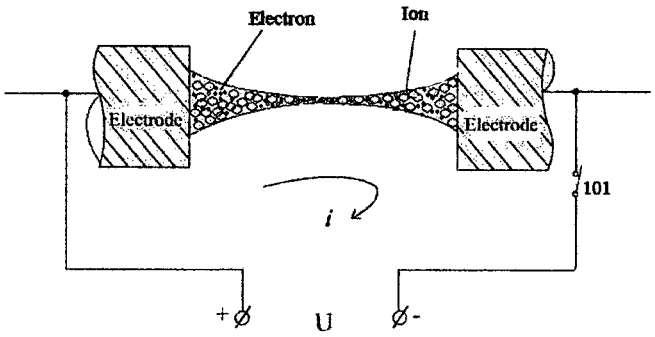
FIG. 1*b* shows a state that the electric arc in FIG. 1*a* is contracted.

Thus some electrons which are accelerated $$\sqrt{K}$$

times reach the surface of the anode rapidly, but the ions seem to be in quiescent state since they are much heavier and slower than electrons. In case the velocity of electrons is increased $\sqrt{K}$ times, perhaps it is regarded that the electric current in the electric arc is also increased as much. Then since the force of electrons becomes greater than that of the ions charged with positive electricity, the plasma gas is contracted according to the principle of relativity as in FIG. 1*b*. Since in the contracted portion the current density and resistance are very big, and a great number of electrons flow into the portion from the external source, U, higher and higher heat occurs in the portion.

Figure 1C:
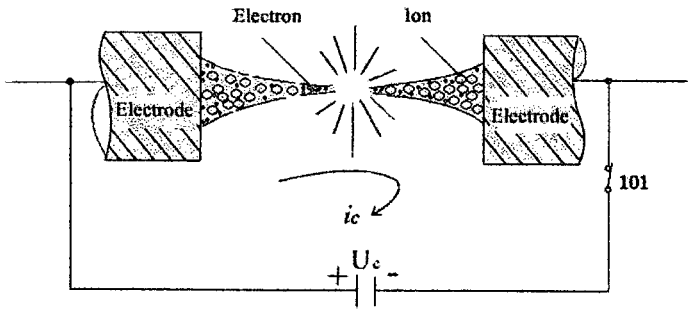
FIG. 1*c* shows a state that the electric arc in FIG. 1*a* is cut.

Once the thermal motion energy of electrons become larger than the bound energy caused by the voltage at both ends of the electric arc, some electrons spring out as in FIG. 1*c* and after all the electric arc is cut like a "fuse". Here $U_c$ is the voltage of the condenser and $i_c$ is the discharge current.

Figure 2:
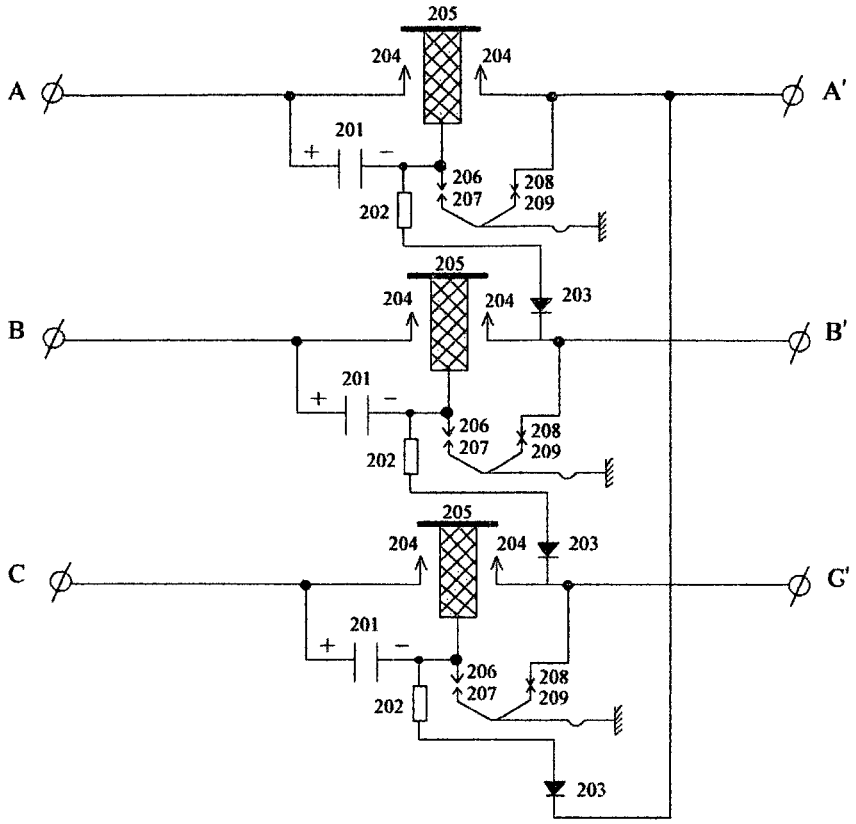
FIG. 2 is a scheme of one circuit for applying the method of extinguishing an electric arc according to the present invention to the contactors which are used at 220 to 600 volts.

FIG. 2 is a scheme of one circuit for applying the method of extinguishing electric arc according to the present invention to the contactors which are used at 220 to 600 volts. In the circuit there are a condenser 201, a resistor 202, a diode 203 and auxiliary contacts 206, 207, 208 and 209. 204 is a fixed contact and 205 is a moving contact. An auxiliary contact 206 is linked to the moving contact 205.

In the state that the fixed contact 204 and the moving contact 205 are separated (the switching-off state) the auxiliary contacts 206 and 207 are separated and the auxiliary contacts 208 and 209 are attached each other. In this state the condenser 204 is not charged.

If the fixed contact 204 and the moving contact 205 are contacted, that is, the contactor is switched-on, the auxiliary contacts 206 and 207 are attached, the auxiliary contacts 208 and 209 are separated and accordingly the condenser 201 is charged through the resistor 202, the diode 203 and the contacts of the next phase. The charging voltage is the maximum value of the supply voltage (the maximum voltage) and the condenser 201 always maintains the maximum voltage.

If the contactor is now switched-off, the moving contact 205 goes upward and then there is a moment the auxiliary contacts 206 and 207, 208 and 209 are attached respectively at the same time.

Then the condenser 201 is discharged through the electric arc formed between the fixed contact 204 and the moving contact 205 and accordingly the electric arc is cut. After that the moving contact 205 still continues to go upward, the auxiliary contacts 207 and 209 are restricted by the auxiliary contact 208 and after all the contactor returns to the original state, that is, the switching-off state.

Figure 3A:
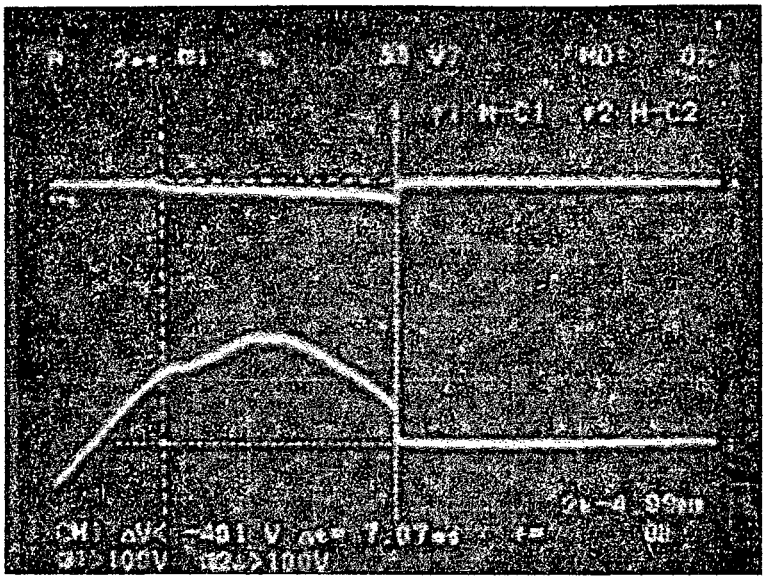
FIG. 3*a* is a graph which shows the break-time of an electric arc in CJ20-40 (made in China).
Figure 3B:
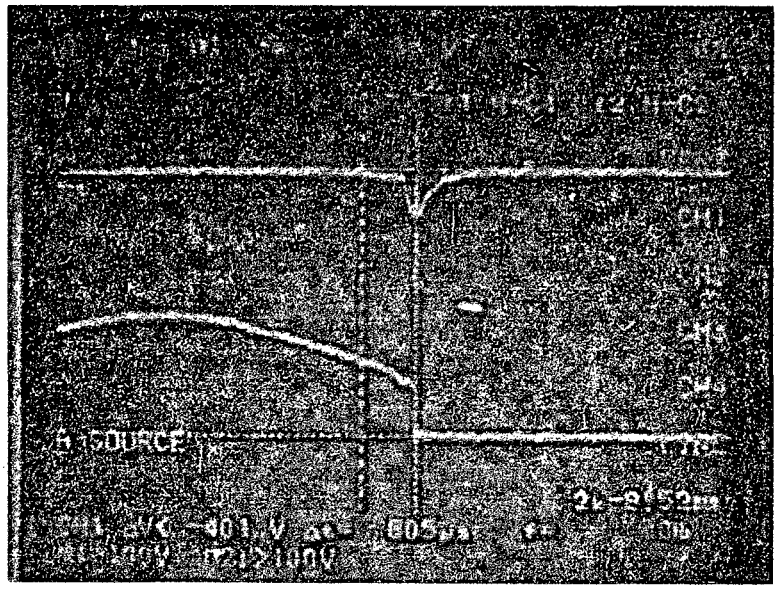
FIG. 3*b* is a graph which shows the break-time of an electric arc in case of applying the circuit in FIG. 2 to CJ20-40 (made in China).

FIG. 3*a* is a graph which shows the break-time of an electric arc in CJ20-40 (made in China) and FIG. 3*b* is a graph which shows the break-time of an electric arc in case of applying the circuit in FIG. 2 to CJ20-40 (made in China).

As can be seen, the break-time of the electric arc is 7.07 ms in the former case but it is 0.805 ms in the latter case, so the breaking speed of the electric arc is almost 10 times faster in the latter case than in the former case. And the electric arc is extinguished when the gap between the main contacts is less than 0.25 mm.

Figure 4A:
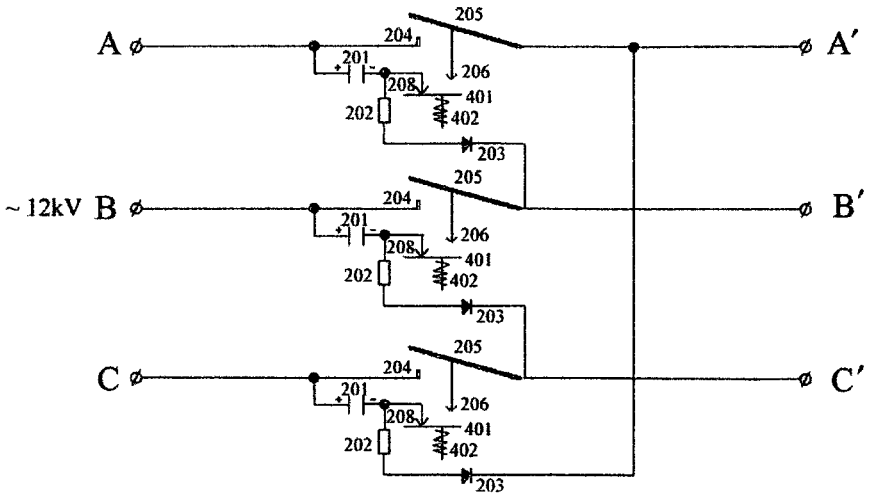
FIG. 4*a* is a scheme of one circuit for applying the method of extinguishing electric arc according to the present invention to high voltage circuit breakers.

FIG. 4*a* is a scheme of one circuit for applying the method of extinguishing electric arc according to the present invention to high voltage circuit breakers.

Figure 4B:
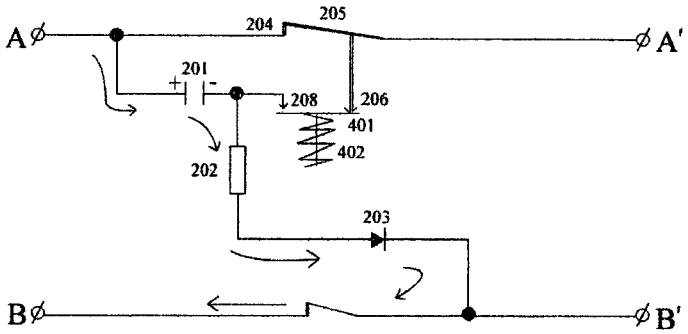
FIG. 4*b* shows the charge path of the condenser in switching-in state in FIG. 4*a*.

The condenser 201, the resistor 202 and the diode 203 are all selected enough to endure the supply voltage. The auxiliary contacts are made of tungsten alloy. In FIG. 4*a* the plate 401, which has two auxiliary contacts, with the spring 402 is separated from the auxiliary contact 206 and is attached to the auxiliary contact 208. If the circuit breaker is switched on, the plate 401 with the spring 402 is attached to the auxiliary contact 206 and is separated from the auxiliary contact 208 as in FIG. 4*b*, so the condenser 201 is charged following the direction of arrows and the maximum voltage is maintained during the whole switching-in state.

Figure 4C:
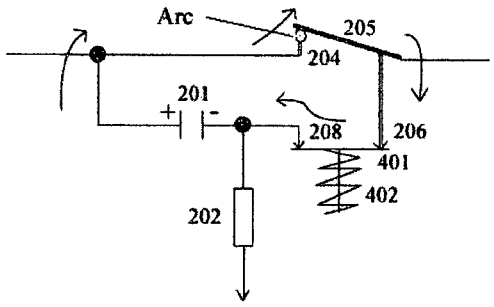
FIG. 4*c* shows the discharge path of the condenser at the moment of switching-off in FIG. 4*a*.

If the circuit breaker is now switched off, the plate 401 with the spring 402 is attached to the auxiliary contacts 206 and 208 together in a moment as in FIG. 4*c* and at this time the condenser 201 is discharged through the electric arc when it is extinguished. After that the moving contact 205 still continues to go upward and accordingly the circuit breaker returns to the initial state. The electric arc is extinguished when the distance between the fixed contact 204 and the moving contact 205 is less than 1.5 mm.

The contacts are all working in oil in order to keep the dielectric strength of the circuit breaker.

Figure 5A:
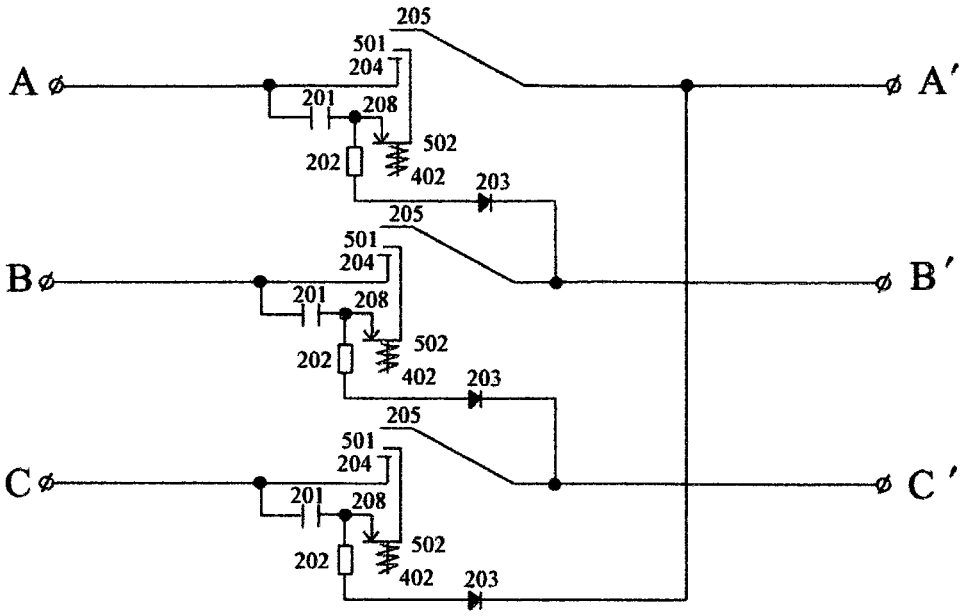
FIG. 5*a* is a scheme of another circuit for applying the method of extinguishing electric arc according to the present invention to high voltage circuit breakers.

FIG. 5*a* is a scheme of another circuit for applying the method of extinguishing electric arc according to the present invention to high voltage circuit breakers.

The intermediate contact maker 501 is placed between the fixed contact 204 and the moving contact 205, but there is no the auxiliary contact 206. In this circuit the condenser 201 is discharged through the auxiliary contact 208 and the plate 502, which has an auxiliary contact on it, with the spring 402.

Figure 5B:
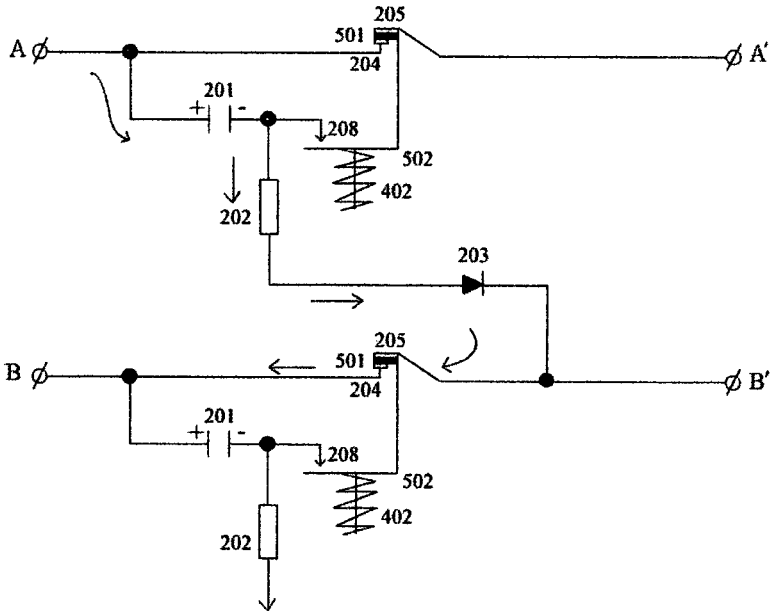
FIG. 5*b* shows the charge path of the condenser in switching-in state in FIG. 5*a*.
Figure 5C:
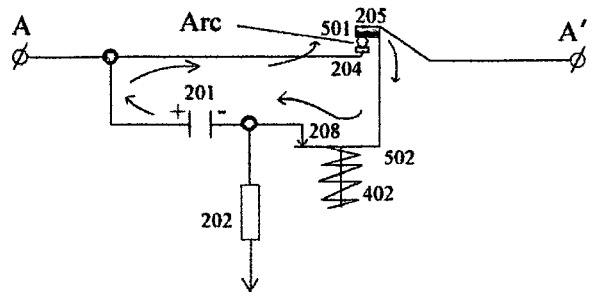
FIG. 5*c* shows the discharge path of the condenser at the moment of switching-off in FIG. 5*a*.

In the switching-in state the fixed contact 204 and the intermediate contact maker 501 are separated each other about 1.5 mm, and the moving contact 205 is separated far from the intermediate contact maker 501. If the circuit breaker is switched on, the condenser 201 is charged following the direction of arrows as in FIG. 5*b*. If it is switched off again, as in FIG. 5*c* the auxiliary contact 208 and the plate 502 with the spring 402 are contacted when the distance between the fixed contact 204 and the intermediate contact maker 501, which is coupled with the moving contact 205, is about 1.5 mm and then the condenser 201 is discharged when the electric arc is extinguished. After that the moving contact 205 continues to go upward and accordingly the circuit breaker returns to the initial state. The contacts are all working in oil.

Figure 6:
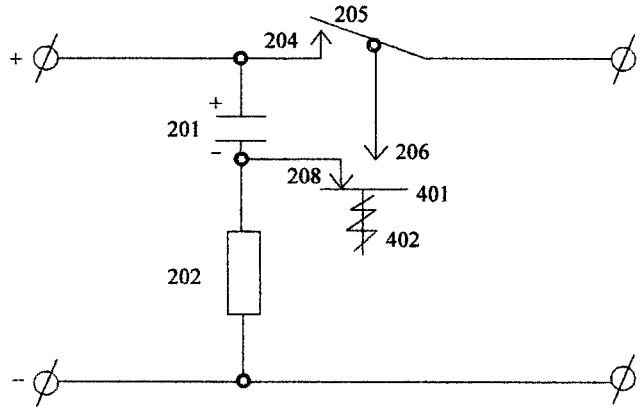
FIG. 6 is a scheme of one circuit for applying the method of extinguishing electric arc according to the present invention in case of direct current and low voltage.

FIG. 6 is a scheme of one circuit for applying the method of extinguishing electric arc according to the present invention in case of direct current and low voltage.

This circuit does not contain any diode since it is for direct current. The action principle of this circuit is the same as one in FIG. 4.

The characteristics of a 12 kV/630 A high voltage circuit breaker to which the method of extinguishing electric arc according to the present invention is applied are shown in Table 1.

TABLE 1

| No | Particulars | Unit | Size |
|---|---|---|---|
| 1 | Rated voltage | kV | 12 |
| 2 | Rated current | A | 630 |
| 3 | Rated short current | kA | 20 |
| 4 | Impulse withstand voltage | kV | 75 |
| 5 | The number of times of rated short-circuit switching | time | More than 300 |
| 6 | Rated operating voltage | V | DC 110 or 220 |
| 7 | Weight | kg | 160 |

The invention claimed is:

1. A method of extinguishing an electric arc of a switchgear by pulse discharge, comprising connecting to the switchgear a nonpolar condenser fully charged up to a maximum supply voltage (maximum voltage), a capacitance of the nonpolar condenser providing directly to both ends of electrical contacts of the switchgear much higher discharge energy than an energy of the electric.

2. A method according to claim 1, where the condenser is charged up to the maximum value of the supply voltage using one of: i) a resistor and a diode; or ii) a resistor.

3. A method according to claim 2, where the condenser is connected directly to both ends of the electrical contacts of the switchgear at the moment when extinguishing occurs.

4. A method according to claim 1, where the discharge of the condenser is adjusted by auxiliary contacts, including:

i. an auxiliary contact or an intermediate contact-maker that can be moved following motion of a moving contact of the switchgear by linking the auxiliary contact to the moving contact or installing the intermediate contact-maker between a fixed contact and the moving contact of the switchgear; wherein ii. the condenser is not allowed in the switching-in state of the switchgear to be connected to both ends of the contact portion of the fixed contact and the moving contact, or of the fixed contact and the intermediate contact-maker; and.

iii. the condenser is connected directly to both ends of electrical contacts of the switchgear at the moment when extinguishing occurs with the switchgear switched-off.

5. A method according to claim 4, where auxiliary contacts are all made of tungsten alloy.

6. A method according to claim 4, where the main and auxiliary contacts of high voltage switchgears are all working in oil.

7. A method according to claim 4, where the main, and auxiliary contacts of high voltage switchgears are all working in vacuum.

8. A method according to claim 4, where the main and auxiliary contacts of high voltage switchgears are all working in gas.

* * * * *